US005274933A

United States Patent [19]

Cole et al.

[11] Patent Number: 5,274,933

[45] Date of Patent: Jan. 4, 1994

[54] METHOD AND APPARATUS FOR DISPLAYING AND TESTING SELF-SERVICE SHOES

[75] Inventors: Robert J. Cole, Lansing; Larry J. Hochberg, Glencoe, both of Ill.

[73] Assignee: Sportmart, Inc., Niles, Ill.

[21] Appl. No.: 729,776

[22] Filed: Jul. 10, 1991

Related U.S. Application Data

[63] Continuation of Ser. No. 620,373, Nov. 28, 1990, abandoned, which is a continuation of Ser. No. 439,788, Nov. 21, 1989, abandoned.

[51] Int. Cl.[5] ..... A43C 11/22

[52] U.S. Cl. ..... 36/136

[58] Field of Search ..... 36/132, 136, 138; 24/298, 300, 301, 302, 16

[56] References Cited

U.S. PATENT DOCUMENTS

| | | | |
|---|---|---|---|
| 393,595 | 11/1888 | Veatch | 24/298 |
| 794,561 | 7/1905 | Spencer . | |
| 897,476 | 9/1908 | Milliken . | |
| 1,434,532 | 11/1922 | Davala et al. . | |
| 1,470,280 | 10/1923 | McCulloch . | |
| 2,820,269 | 1/1958 | Wolff | 24/300 |
| 2,884,399 | 8/1961 | Grahling | 119/96 |
| 3,000,067 | 9/1961 | Hanflig | 24/87 |
| 3,041,743 | 7/1962 | Monsma | 36/1 |
| 3,482,335 | 12/1969 | Ornsteen | 36/1 |
| 3,692,361 | 9/1972 | Ivarsson | 24/298 |
| 3,889,399 | 6/1975 | Emrich | 36/1 |
| 4,170,299 | 10/1979 | Clements | 206/342 |
| 4,624,060 | 11/1986 | Maxwell | 36/1 |

*Primary Examiner*—Daniel P. Stodola
*Assistant Examiner*—John P. Darling
*Attorney, Agent, or Firm*—Laff, Whitesel, Conte & Saret

[57] ABSTRACT

A coiled shoe connector (14) is provided to connect a first shoe (10) to a second shoe (12). The coiled connector (14) has a relaxed length (L) and an expanded length (L2). The pair of shoes (10 and 12) are interconnected by the coiled connector (14) for display with the connector (14) in its relaxed length (L). To test the pair of shoes (10–12), a customer may walk in the shoes by repeatedly stretching the coiled connector (14) between its relaxed length (L) and its expanded length (L2). In a preferred embodiment, the coiled connector (14) is reusable and is therefore, connected to the shoes (10–12) by a separate fixing element (36). After a customer has tested the shoes (10–12) and decided to purchase them, the shoes (10–12) are deposited with a sales clerk. The sales clerk may then cut the fixing elements (36) in order to retain the coiled connector (14) for reuse. The coiled connector (14) thus provides a convenient method for connecting a pair of shoes for self-service display that allows a customer to test-walk the shoes without fear of injury due to tripping over a connecting cord.

10 Claims, 3 Drawing Sheets

METHOD AND APPARATUS FOR DISPLAYING AND TESTING SELF-SERVICE SHOES

This application is a continuation of application Ser. No. 07/620,373, filed Nov. 28, 1990, now abandoned which was a continuation of application Ser. No. 07/439,788, filed Nov. 21, 1989, which is now abandoned.

TECHNICAL FIELD OF THE INVENTION

This invention relates in general to security devices, and in particular to a method and apparatus for displaying and testing self-service shoes.

BACKGROUND OF THE INVENTION

The self-service display and sale of shoes has greatly increased over the years to where self-service shoe stores and/or sections in larger stores are to be found virtually everywhere. In such self-service stores, it is important to display the shoes for customer selection and testing in a convenient fashion.

Unfortunately, the more convenient the display of shoes for a customer's selection and testing, the more inconvenient for a retailer. Since the customer wants to be able to look at the shoes as a pair, the shoes must be displayed as a pair or in a fashion that will allow quick location of the pair desired. Additionally, the customer typically desires to wear the shoes on both feet for test walking the shoes as much as possible and perhaps even for running or jumping in the shoes (especially if they are athletic shoes). These requirements for customer satisfaction make the retailer's job more difficult in that shoes may become separated as pairs by inconsiderate or inattentive customers replacing the pairs in incorrect locations. Even worse, customers may place the shoes on their feet and depart the store without paying.

Thus, it has become necessary to provide devices to allow shoes to be displayed as a pair and tested by the customer without losing the identity of the pair of shoes. These methods have included the use of tabs fixed to the shoe with a string or strap interconnecting the tabs. One such method is disclosed in U.S. Pat. No. 3,000,067 to Hanflig, Sep. 19, 1961. The Hanflig patent discloses a flexible line terminating on each end in a metal clip for attachment to each shoe. The metal clip is secured to a portion of the shoe upper by punching a sharp tongue section therethrough and into a receiving portion. While this method is adequate for maintaining the integrity of a pair of shoes, there is some inherent damage to the upper of the shoe by the use of the pointed tongue.

Another device used for interconnecting shoes is disclosed in U.S. Pat. No. 3,482,335 to Ornsteen, Dec. 9, 1969. The Ornsteen patent requires the use of a length of plastic, fabric, string or cord glued to the bottom or the inside of each shoe between the upper and lower soles thereof. The two pieces extending from each shoe are then connected together by staples or snap devices to secure the shoes together as a pair for display. This patent also discloses the desirability of making the cords long enough to take a few steps for testing the shoes. Unfortunately, this method requires the destruction of the length of cord to separate the pair of shoes, and a portion of the cord will remain between the soles of each shoe after separation thereof. Additionally, a serious safety concern is presented by the use of a cord long enough for walking. Since the cord is loose and would drape between the feet of a wearer, there is an inherent possibility that the cord could become entangled and trip the wearer.

A still further device for attaching pairs of shoes together is disclosed in U.S. Pat. No. 4,624,060 to Maxwell, Nov. 26, 1986. The Maxwell patent discloses the fixing of tabs between the inner and outer sole of each shoe with holes therein for the connection of a fastening filament. As with the Ornsteen device, this patent leaves a portion of the connection means in each shoe after separation thereof. Additionally, the use of a fastening filament long enough to allow walking would present a similar safety hazard. Thus, there is a need for a method and apparatus for displaying and testing self-service shoes that does not leave a portion thereof in the shoe after removal, does not damage the shoe and is safe for testing of the shoes.

SUMMARY OF THE INVENTION

The present invention disclosed and claimed herein describes a method and apparatus for displaying and testing self-service shoes which substantially eliminates or greatly reduces problems associated with prior shoe coupling devices. The present invention allows the display and test walking of a pair of shoes without the safety concerns of prior devices.

In accordance with one aspect of the invention, a coiled connector which is expandable from a first relaxed length to a second elongated length is fixed to each shoe. The connector is fixed to the shoes with fixing elements such as nylon filaments or snap-on couplings.

An information tag containing such information as size, price, brand name, etc., may also be fixed to the shoe with one of the fixing elements. The shoes are then placed in a side-by-side relationship on an appropriate self-service display for customer selection. The coil in the connector prevents unnecessary clutter and presents a more appealing appearance.

After selecting the connected pair of shoes, a customer may place the shoes on their feet for test walking. To test the shoes, the connector stretches from its first relaxed length to its second elongated length, back to its relaxed length and so on. Due to the coil in the connector, the tendency is for the connector to return to its first relaxed length eliminating or greatly reducing the safety hazard inherent with the prior art devices.

After the customer has tested the shoes and has decided to purchase same, the shoes are deposited with a sales clerk for payment. The sales clerk will detach the coiled shoe connector from the shoes by cutting or otherwise removing the fixing element from each shoe. The coiled shoe connector may be disposed of or retained by the sales clerk for reuse.

It is a technical advantage of the present invention that self-service shoes may be displayed side-by-side in an attractive arrangement and yet securely connected as a pair. It is a further technical advantage that the connected pair of shoes may be safely tested due to the coil of the connector. It is a still further technical advantage of the present invention that the connector may be retained after the sale of the shoes for reuse.

BRIEF DESCRIPTION OF THE DRAWINGS

For a more complete understanding of the present invention and for further advantages thereof, reference is now made to the following Detailed Description taken in conjunction with accompanying Drawings, in which.

DETAILED DESCRIPTION OF THE INVENTION

Figure 1:
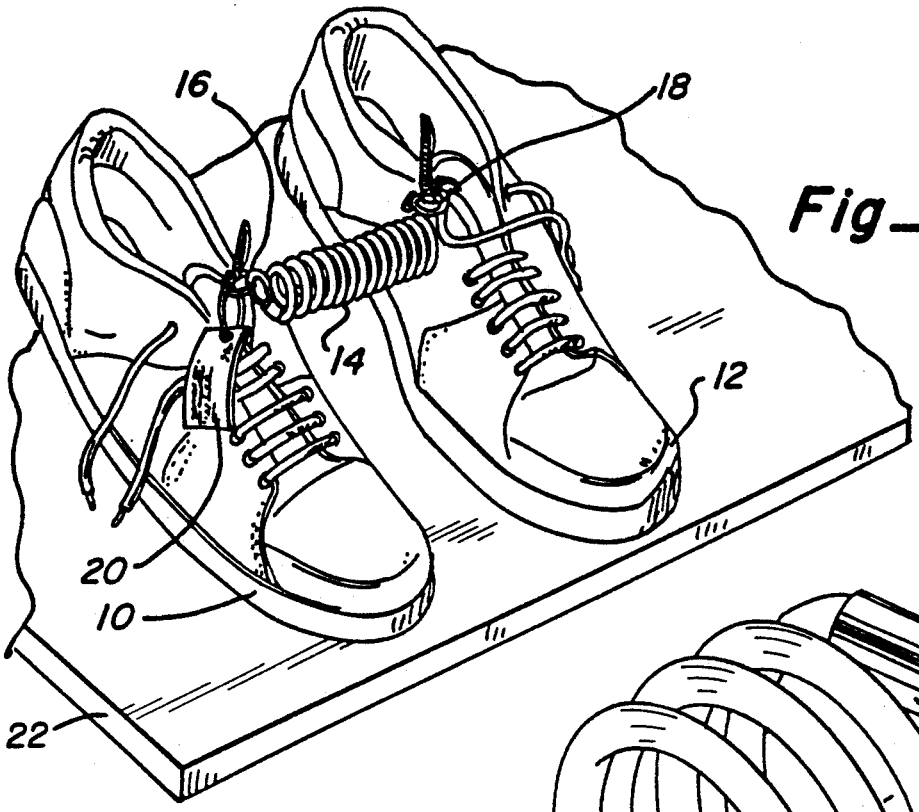
FIG. 1 is a perspective view of a pair of shoes interconnected for display with the present invention.

In FIGS. 1-6, like items are identified by like and corresponding numerals for ease of reference. Referring first to FIG. 1, an isometric view is shown of a pair of shoes displayed for sale in accordance with the preferred embodiment of the present invention. A first shoe 10 is connected to a second shoe 12 by a coiled connector 14. The coiled connector 14 is attached at a first end 16 to the first shoe 10 and at a second end 18 to the second shoe 12 by any appropriate method which will be subsequently described in greater detail.

Attached to shoe 10 (or shoe 12, as desired) is an information tag 20. The information tag 20 may contain size, price or any other appropriate instructions. The tag 20 is preferably connected to the shoe 10 or 12 in the same fashion as the first and second ends 16-18 of the connector 14. Since the shoes 10 and 12 are securely connected by the connector 14 only one tag 20 is required for each pair of shoes. The connected shoes 10 and 12 may then be placed on a display rack 22 for observation and selection thereof by a customer.

Due to the coiled connector 14, the shoes 10 and 12 are conveniently displayed as a pair without fear of their separation. Additionally, the coiled connector 14 provides a neat and uncluttered display of the shoes 10 and 12 due to the compact design thereof.

Figure 2:
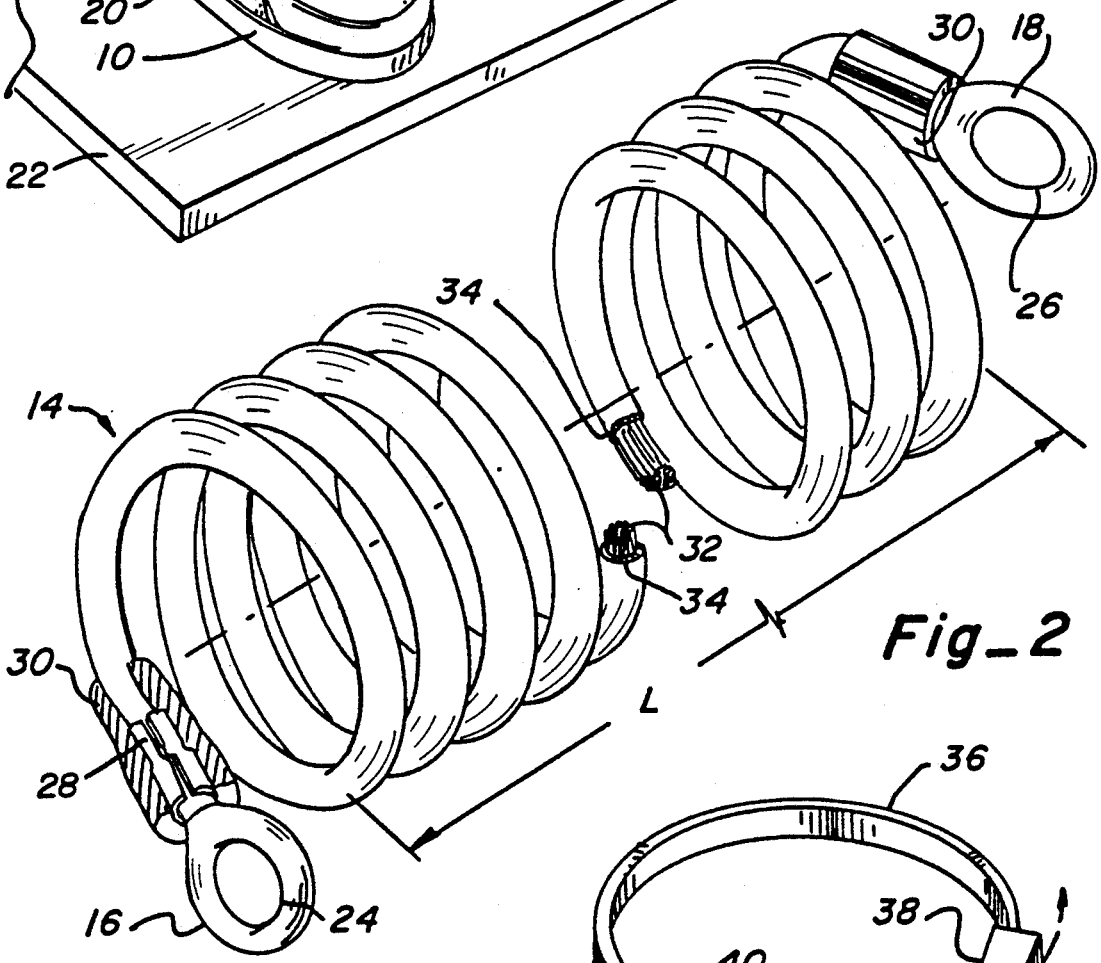
FIG. 2 is a perspective view of the coiled connector in accordance with a preferred embodiment of the present invention.

Referring to FIG. 2, the coiled connector 14 is shown in accordance with the preferred embodiment of the present invention. The first and second ends 16-18 are provided with loops 24 and 26. The loops 24 and 26 are then permanently held in place on the ends 16-18, respectively, by crimping butterfly portions 28 (as shown cutaway on end 16) around the coiled connector 14. The crimped butterfly portions 28 and the loops 24-26 are then preferably covered with a protective coating 30, such as, for example, plastic tape (loops 24-26 are not shown covered for the sake of simplicity).

As shown in the cutaway portion, the connector 14 comprises an inner portion 32 and an outer protective coating 34. The inner portion 32 may comprise any appropriate material such as braided wire that is capable of being formed into a coil and returning to the coiled configuration after being repeatedly stretched.

The protective outer coating 34 may comprise, for example, plastic or rubber to protect the surface of the shoe from scuffing by or abrasions from the inner portion 32. In the preferred embodiment, the connector 14 is designed to be reusable, thus a separate fixing element is required for connection to the shoes.

The coiled connector 14 is formed with a first relaxed length L which is sufficient to connect a pair of shoes without sagging or causing excessive clutter. As will subsequently be described in greater detail, the connector 14 also has a second elongated length L2 which allows a customer to take a test walk in the shoes.

Figure 3:
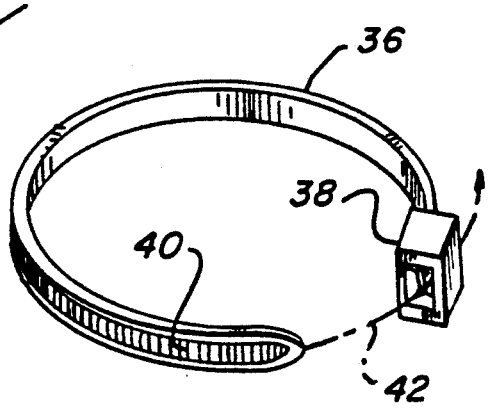
FIG. 3 is a perspective view of a fixing element.

Referring to FIG. 3, a fixing element 36 is shown. The fixing element 36 is one possible device used to connect the first and second loops 24 and 26 of the coiled connector 14 to the first shoe 10 and first shoe 12. Although element 36 is the only separate connecting element shown, it is to be understood that there are many other possible connectors that would serve the connecting purpose equally as well.

The fixing element 36 may comprise any appropriate material such as a nylon strap, a ziplock or a nylon filament, all of which are well known in the art. The fixing element 36 has a receiver 38 and a locking ribs 40 for insertion therein. By placing the locking ribs 40 within the receiver 38 and pushing in a direction illustrated by a dashed arrow 42, the fixing element 36 is securely locked in a closed condition. Thus, it is possible to insert the fixing element 36 through the first or second loops 24-26 and then through a shoe eyelet (or other similar device inherent to the shoe). By attaching the coiled connector 14 to shoes 10 and 12 with the fixing element 36, there is no damage to the shoes 10 or 12 and, yet, the shoes are conveniently interconnected as a pair.

Figure 4:
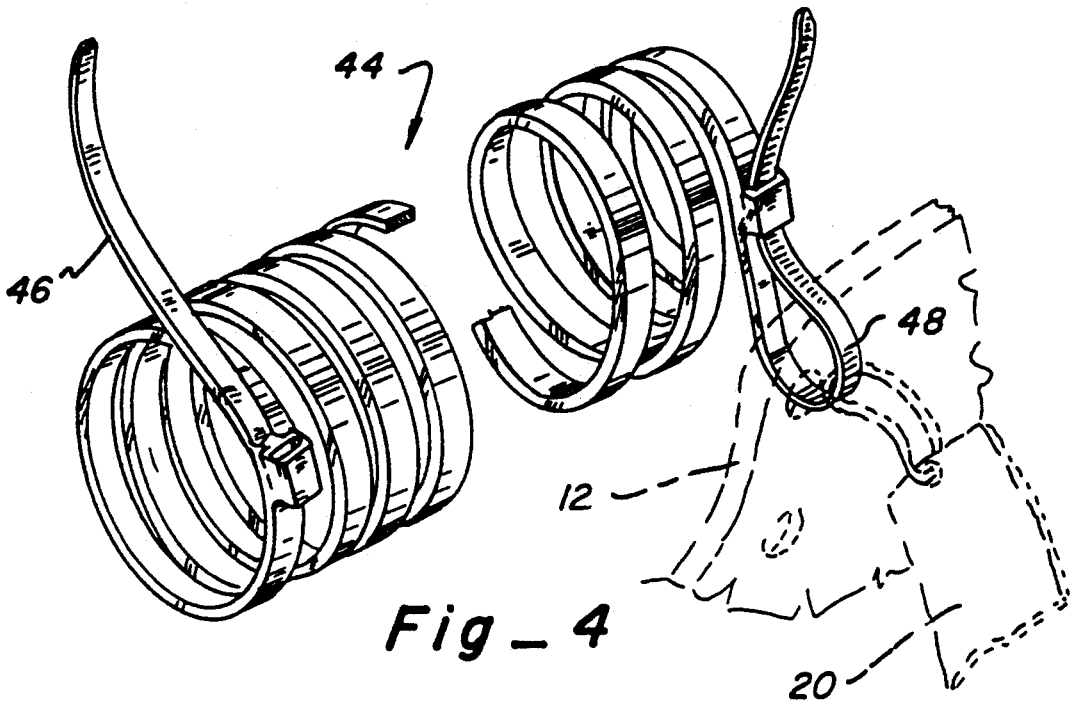
FIG. 4 is a perspective view of an alternative embodiment of the present invention.

Referring to FIG. 4, an alternative embodiment of the present invention is illustrated. The coiled connector 44 comprises a one-piece element such as, for example, plastic. The plastic material must have sufficient memory to allow the formation of the coil and return thereto after being elongated. The first connecting element end 46 is left open for subsequent attachment to another shoe while the second connecting element end 48 is shown attached to the shoe 12.

Upon attachment to a shoe, the first and second ends 46 and 48 are inserted through a portion of the shoe, such as an eyelet, and then clipped together. The first and second ends 46 and 48 may comprise any suitable clipping arrangement such as locking ribs and a receiver similar to that shown in FIG. 3 above. The alternative embodiment, as shown in FIG. 4, will provide the advantages of the present invention, but will be disposable rather than reusable.

Figure 5:
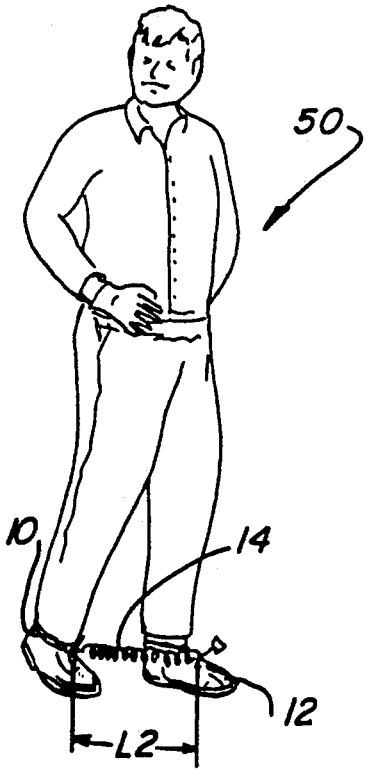
FIG. 5 is a perspective view of a customer testing the shoes interconnected with the present invention.

Referring to FIG. 5, a wearer 50 is shown testing the pair of shoes 10 and 12 which are connected by the coiled connector 14 (or 44). The connector 14 is shown in the second elongated length L2. The second elongated length L2, for example, approximately 40 inches, is sufficient to allow the wearer 50 to walk in the shoes 10 and 12 for testing thereof. Due to the coiled configuration of the connector 14, as the wearer 50 walks in the shoes 10 and 12, the connector 14 tends to return to its first relaxed length L. Thus, the connector 14 will not create a tripping hazard for the wearer 50 and provides a safe and economical method for maintaining the shoe pair integrity in a self-service environment.

Figure 6:
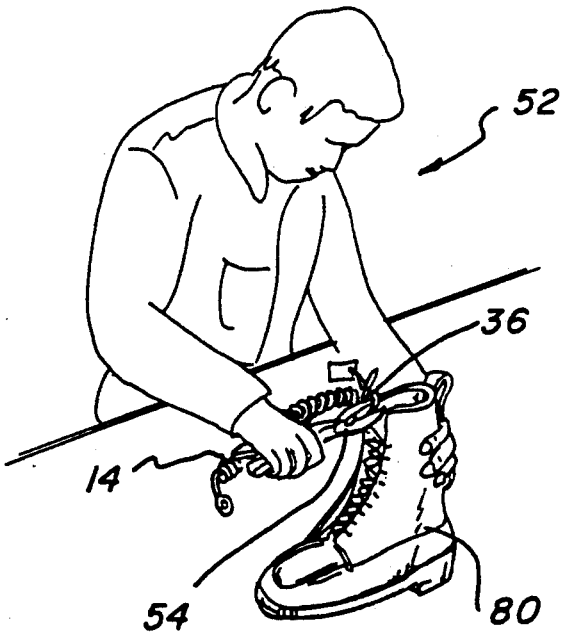
FIG. 6 is a perspective view of the purchase of the shoes and removal of the connector of the present invention.

Referring to FIG. 6, the wearer 50 has decided to purchase a pair of shoes 80 (only one of which is shown) and has deposited same with a sales clerk 52. The sales clerk 52 will then disconnect the coiled connector 14 from the shoes 80 such as by cutting the fixing elements 36 with a scissors 54. The connector 14, once severed from the shoes 80, may then be stored for reuse with another pair of shoes. If the shoes 80 are connected by the connector 44, the sales clerk 52 must sever the first and second ends 46 and 48 thereof and dispose of the connector 44. Optionally, the connector 44 may be left on the shoes for subsequent removal by the wearer 50.

Figure 7:
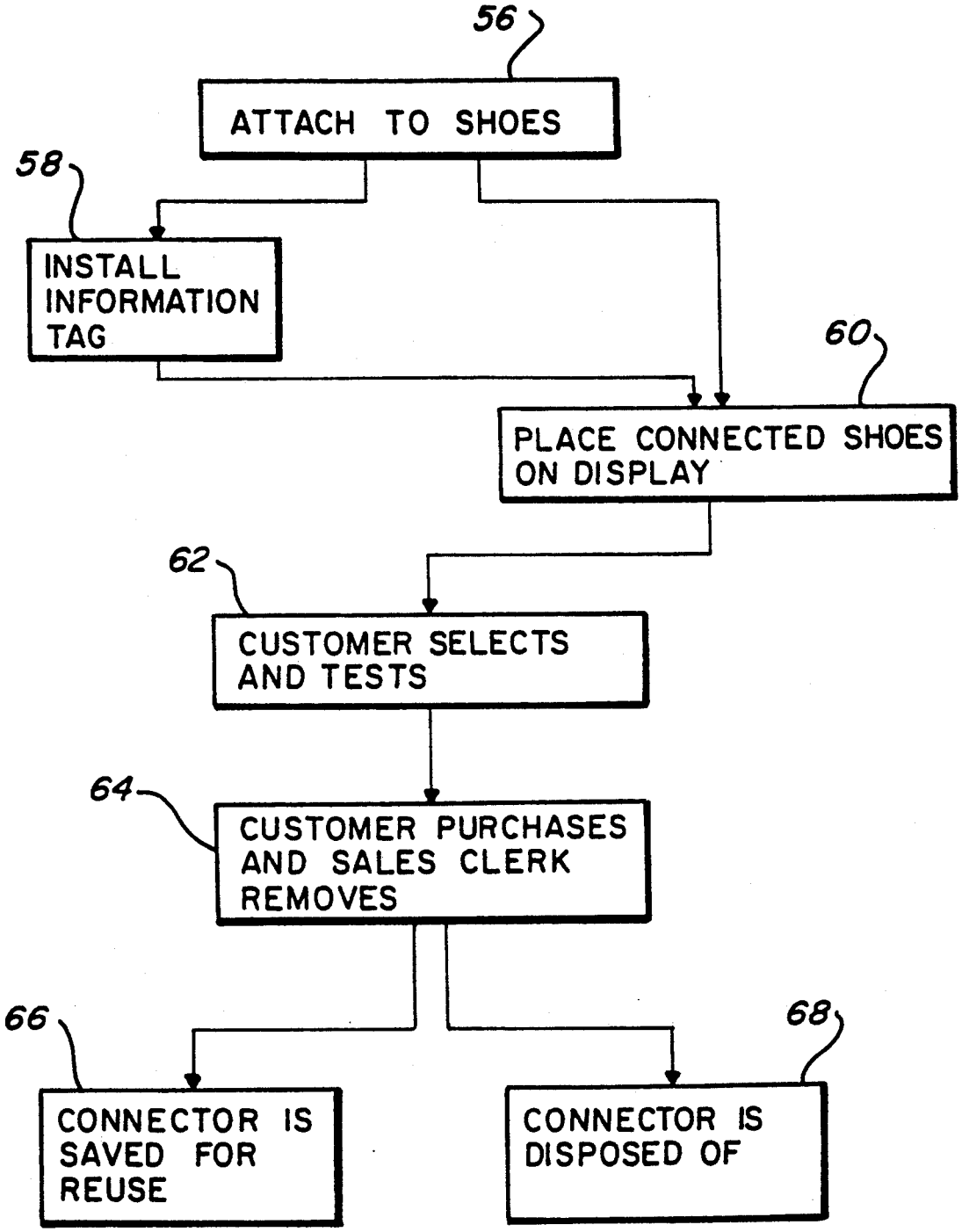
FIG. 7 is a flow chart of the method of the present invention.

Referring to FIG. 7 a flow chart is illustrated in accordance with the method of the present invention. At 56, the coiled connector 14 or 44 is attached to a pair of shoes. At 58, the price or information tag 20 may be connected to one of the shoes at the same time as the coiled connector 14. Alternatively, a tag 20 need not be affixed to the shoes and the connected shoes 10 and 12 may be placed directly on display as in 60.

At 62, a customer will select the shoes and try them on for test walking thereof. During the testing due to the coiled configuration of the connector 14 the customer 50 is able to walk in the shoes without tripping over the connector 14. At 64, the customer purchases the pair of shoes and a sales clerk removes the connector 14. The connector 14 is saved for reuse at 66 or the connector 44 is disposed of at 68.

Although the present invention has been described with respect to a specific preferred embodiment thereof, various changes and modifications may be suggested to one skilled in the art, and it is intended that the present invention encompass such changes and modifications as fall within the scope of the appended claims.

What is claimed is:

1. Shoes adapted for self-service selection and for convenient and safe testing for foot fit and for comfort on walking, comprising:

a pair of shoes; and expandable means for interconnecting said pair of shoes, said expandable means being capable of stretching from a contracted state in which said pair of shoes can be displayed side-by-side with said expandable means disposed therebetween for selection by a potential customer, to elongated states permitting said pair of shoes to be tested by the potential customer for foot fit and to be tested for comfort on walking, said expandable means also being capable of returning to said contracted state permitting said shoes to be redisplayed side-by-side with said expandable means disposed therebetween, said expandable means further including means for removable, damage-free attachment to each of the shoes of said pair of shoes.

2. The shoes of claim 1 in which said expandable means includes means for attachment to the shoes which are detachable from said shoes so that no pieces of said attachment means remain with said shoes after detachment thereof.

3. The shoes of claim 2 in which the attachment means comprises a length of nylon strap.

4. The shoes of claim 3 wherein said nylon strap further comprises a receiver and locking ribs for insertion into said receiver.

5. The shoes of claim 2, wherein said attachment means is integral with said expandable means.

6. The shoes of claim 1 in which said pair of shoes have eyelets and said attachment means are attached to an eyelet of each of the shoes of said pair of shoes.

7. The shoes of claim 1 in which said expandable means comprises a coiled connector.

8. The shoes of claim 7 wherein said coiled connector comprises an inner portion and a protective outer coating to prevent damage to the shoes.

9. A method for facilitating convenient and safe self-service testing of pairs of shoes by potential customers comprising:

interconnecting matching pairs of shoes with expandable means for stretching from a contracted state in which said pairs of shoes are displayed side-by-side with said expandable means disposed therebetween for selection by a potential customer, to elongated states permitting said pairs of shoes to be tested by the potential customer for foot fit and to be tested for comfort on walking;

displaying said pairs of shoes side-by-side for selection by potential customers;

providing facilities for testing of selected pairs of said shoes for fit and for comfort on walking while said pairs of shoes remain interconnected and said expandable means is elongated;

redisplaying any of said pairs of shoes not chosen for purchase by the customer in side by side fashion with said expandable means in said contracted state; and removing said expandable means from any pairs of said shoes chosen by the customer for purchase.

10. In a system for self-service sale of shoes in which pairs of shoes are interconnected to prevent mismatching by self-service customers, the improvement comprising:

attaching matching pairs of shoes with expandable means capable of stretching from a contracted state in which said matching pairs of shoes can be displayed side-by-side for selection by a potential customer to elongated states in which said matching pairs of shoes can first be tested by customers for foot fit and then tested for comfort on walking while they remain interconnected.

* * * * *